US008499767B2

(12) United States Patent
Ricketts et al.

(10) Patent No.: US 8,499,767 B2
(45) Date of Patent: Aug. 6, 2013

(54) SMOKING ARTICLE

(75) Inventors: Nikolaus Martin Ricketts, Tokyo (JP); Dionis Borgognon, Neuchatel (CH); Charles Kuersteiner, Jouxtens-Mezery (CH)

(73) Assignee: Philip Morris USA Inc., Richmond, VA (US)

( * ) Notice: Subject to any disclaimer, the term of this patent is extended or adjusted under 35 U.S.C. 154(b) by 752 days.

(21) Appl. No.: 12/213,009

(22) Filed: Jun. 12, 2008

(65) Prior Publication Data

US 2008/0314399 A1 Dec. 25, 2008

(30) Foreign Application Priority Data

Jun. 12, 2007 (EP) ..... 07252367

(51) Int. Cl.
*A24D 3/06* (2006.01)

(52) U.S. Cl.
USPC ..... 131/331; 131/336; 131/209; 131/339; 131/340; 131/361

(58) Field of Classification Search
USPC ..... 131/360, 361, 365
See application file for complete search history.

(56) References Cited

U.S. PATENT DOCUMENTS

| | | | | |
|---|---|---|---|---|
| 2,747,579 | A * | 5/1956 | Gage et al. | 131/361 |
| 2,909,312 | A * | 10/1959 | Conerty | 229/235 |
| 2,936,763 | A * | 5/1960 | Saffir | 131/336 |
| 3,368,566 | A * | 2/1968 | Avedikian | 131/334 |
| 4,648,413 | A * | 3/1987 | Saintsing et al. | 131/336 |
| 5,076,292 | A * | 12/1991 | Sensabaugh et al. | 131/194 |
| 7,789,089 | B2 * | 9/2010 | Dube et al. | 131/360 |
| 2007/0095357 | A1 * | 5/2007 | Besso et al. | 131/361 |

FOREIGN PATENT DOCUMENTS

| | | | |
|---|---|---|---|
| CA | 913486 | A | 10/1972 |
| EP | 0193670 | A1 | 9/1986 |
| EP | 0664089 | A1 | 7/1995 |
| GB | 746146 | A | 3/1956 |
| WO | WO 2007/052170 | A2 | 5/2007 |

OTHER PUBLICATIONS

International Preliminary Report on Patentability issued Dec. 17, 2009 for PCT/IB2008/002577.
International Search Report and Written Opinion mailed Mar. 3, 2009 for PCT/IB2008/002577.
International Search Report dated Nov. 6, 2007 for European Patent Application No. EP07252367.
Eastman Chemical Company: "Environmentally disintegratable cigarette filters" Research Disclosure, Mason Publications, Hampshire, GB, vol. 386, No. 25, Jun. 1996, ISSN: 0374-4353.

* cited by examiner

*Primary Examiner* — Richard Crispino
*Assistant Examiner* — Phu Nguyen
(74) *Attorney, Agent, or Firm* — Buchanan Ingersoll & Rooney PC

(57) ABSTRACT

A smoking article comprises a rod of smokable material circumscribed by a rod wrapper and a filter comprising at least one filter segment circumscribed by a filter wrapper. The rod of smokable material and the filter are attached to one another by tipping paper and the smoking article comprises a tear ribbon between the at least one filter segment and the tipping paper. The tear ribbon is affixed to at least one of the tipping paper and the filter wrapper.

11 Claims, 2 Drawing Sheets

SMOKING ARTICLE

CROSS-REFERENCE TO RELATED APPLICATION

This application claims priority under 35 U.S.C. §119 to European Application No. 07252367.3, filed Jun. 12, 2007, the entire content of which is hereby incorporated by reference.

FIELD OF THE INVENTION

The present invention relates to an improved smoking article and in particular to an improved filter cigarette.

BACKGROUND

Filter cigarettes typically comprise a rod of tobacco cut filler surrounded by a paper wrapper and a cylindrical filter aligned in an end-to-end relationship with the wrapped tobacco rod. The wrapped tobacco rod and the filter are normally joined by a band of substantially water impermeable tipping paper. The tipping paper circumscribes the entire length of the filter and an adjacent portion of the wrapped tobacco rod. In conventional filter cigarettes, the filter usually consists of a plug of cellulose acetate tow wrapped in water permeable plug wrap. However, filters comprising other filtration materials such as crepe paper and viscose are also known, as well as multi-component filters that comprise two or more segments of filtration material.

When the butt of a conventional filter cigarette is discarded after smoking, the substantially water impermeable band of tipping paper slows down the process of degradation of the butt.

It would be desirable to provide a smoking article comprising a filter that gives rise to a butt that is capable of degrading more rapidly when discarded compared to the butts of conventional smoking articles with filters.

SUMMARY

According to one embodiment there is provided a smoking article comprising: a rod of smokable material circumscribed by a rod wrapper; a filter comprising at least one filter segment circumscribed by a filter wrapper, wherein the rod of smokable material and the filter are attached to one another by tipping paper; and a tear ribbon between the at least one filter segment and the tipping paper, wherein the tear ribbon is affixed to at least one of the tipping paper and the filter wrapper.

The tear ribbon between the tipping paper and the at least one filter segment facilitates tearing open of the tipping paper by a consumer. By pulling on the tear ribbon prior to discarding the butt of a smoking article, a consumer may tear open the tipping paper. This enables environmental moisture to readily penetrate the at least one filter segment of the filter. The consumer may thereby advantageously decrease the amount of time taken for the discarded butt of the smoking article to degrade.

The tear ribbon may be any elongate member capable of being pulled by a consumer in order to tear open the tipping paper including, but not limited to a tape, strip or thread. Preferably, the tear ribbon is a thread, more preferably a thread having a diameter of between about 0.1 mm and about 1.2 mm, most preferably a thread having a diameter of about 0.4 mm.

The diameter of the tear ribbon is preferably adjusted to the thickness of the filter wrapper or the thickness of the tipping paper or to both the thickness of the filter wrapper and the thickness of the tipping paper. For example, a tear ribbon of larger diameter may be used for a filter wrapper of greater thickness. The tear ribbon may be a thread made of cellulose acetate, cotton, rayon, plastic, metal or hydrophilic textile or non-textile materials or combinations thereof. Preferably, the thread is made from one or more materials capable of absorbing an adhesive.

Preferably, the tear ribbon is degradable. Preferably, the degradation time of the tear ribbon is similar to the degradation time of the filter.

The tear ribbon may be loaded with a flavourant.

Preferably, the tear ribbon is arranged substantially longitudinally between the at least one filter segment and the tipping paper. More preferably, the tear ribbon is substantially parallel to the longitudinal axis of the smoking article. Alternatively, the tear ribbon may be arranged spirally around the at least one filter segment.

Preferably, the smokable material is tobacco cut filler.

Preferably, the rod wrapper is cigarette paper.

Preferably, the filter wrapper is plug wrap.

Preferably, the filter wrapper is an air permeable wrapper.

The smoking articles may include multi-segment filters comprising two or more filter segments.

Each of the individual filter segments of a multi-segment filter is typically circumscribed by at least one wrapper. The individual wrapped filter segments are typically joined to one another by one or more further wrappers to form the multi-segment filter. Where the smoking article comprises a multi-segment filter, the filter wrapper is the outermost wrapper of the assembled multi-segment filter.

The tear ribbon is preferably adhered to at least one of the tipping paper and the filter wrapper by adhesive.

The tear ribbon should be sufficiently strongly affixed to at least one of the tipping paper and the filter wrapper so that, in use, it is not drawn outwardly from between the at least one filter segment and the tipping paper by a consumer pulling on it. Preferably, the tear ribbon is affixed to at least one of the tipping paper and the filter wrapper along substantially its entire length. It will be appreciated, however, that the tear ribbon may be affixed to at least one of the tipping paper and the filter wrapper along only a portion of its length. For example, the tear ribbon may be affixed to at least one of the tipping paper and the filter wrapper at a plurality of spaced apart discrete points or regions along its length.

Preferably, the tear ribbon is affixed to the filter wrapper. Affixing the tear ribbon to the filter wrapper advantageously enables a consumer to tear open both the tipping paper and the filter wrapper of smoking articles by pulling on the tear ribbon. More preferably, the tear ribbon is affixed to the inner surface of the filter wrapper. Affixing the tear ribbon to the inner surface of the filter wrapper advantageously ensures that the filter wrapper is torn.

Throughout the specification, the term "inner surface" denotes the surface of the filter wrapper or tipping paper that faces the interior of the smoking article.

Where the tear ribbon is affixed to the filter wrapper, the filter wrapper preferably includes at least one line of weakness proximate the tear ribbon. More preferably, the filter wrapper includes two lines of weakness proximate the tear ribbon, the tear ribbon being located between the two lines of weakness. Preferably, the distance between the two lines of weakness is between about 2 mm and about 4 mm, more preferably about 2.5 mm. The provision of at least one line of weakness in the filter wrapper advantageously facilitates tearing of the filter wrapper by a consumer.

Preferably, the at least one line of weakness is substantially parallel to the tear ribbon. Preferably, the length of the at least one line of weakness is substantially the same as the length of the tear ribbon.

The at least one line of weakness may be formed by stamping, scoring, perforating, embossing or otherwise compressing, cutting or weakening the filter wrapper. Preferably, the at least one line of weakness is a line of perforations, for example laser perforations.

Preferably, the tear ribbon extends from a mouth end of the filter, distant from the rod of smokable material.

Preferably, the tear ribbon is visible at the mouth end of the filter. Inclusion of a tear ribbon that is visible at the mouth end of the filter advantageously provides a visual reminder to a consumer to pull on the tear ribbon prior to discarding the butt of the smoking article.

Preferably, the tear ribbon is colored. Inclusion of a colored tear ribbon facilitates identification of the tear ribbon by a consumer.

Preferably, the tear ribbon extends along substantially the entire length of the filter wrapper. The tear ribbon may extend substantially along the entire length of the tipping paper.

The smoking article may include a filter comprising filter segments of any suitable known filtration materials including, but not limited to, cellulose acetate tow, crepe paper and activated carbon. The filter may comprise one or more filter segments of filtration material. The filter may also comprise one or more filter segments that comprise flavour-bearing material such as, for example, plant material, breakable capsules containing flavourants, flavour-bearing granules or other materials loaded with flavour. Alternatively or in addition, the filter may comprise one or more filter segments that comprise filtration material and flavor-bearing material. For example, the filter may comprise one or more filter segments comprising flavour-bearing granules suspended within a filtration material or one or more flavour-bearing threads extending through a filtration material.

The filter may further comprise a recess or cavity at the mouth end thereof distant from the rod of smokable material. The provision of a recess at the mouth end of the filter may advantageously facilitate access to the tear ribbon by a consumer.

Where the filter comprises a recess or cavity, a filter wrapper with a greater thickness is preferred to increase the mechanical stability of the filter. For example, where the filter comprises a recess or cavity, the filter wrapper may have a weight of between about 40 grams per square meter and about 50 grams per square meter, more preferably a weight of about 44 grams per square meter, and a thickness of between about 120 and about 160 microns, more preferably of about 140 microns. Where the filter comprises a recess or cavity, the filter wrapper preferably has a permeability of about 11500 Coresta units.

The smoking article preferably comprises a filter comprising up to five filter segments or up to four filter segments and a recess at the mouth end thereof.

Preferably, the filter comprises filter segments having a length of between about 3 mm and about 12 mm, more preferably a length of between about 10 mm and about 12 mm.

Preferably, the filter has a diameter of between about 5 mm and about 8.5 mm, more preferably a diameter of about 7.9 mm.

Preferably, the filter has a length of between about 18 mm and about 36 mm, more preferably a length of about 27 mm.

The smoking article preferably has an overall length of between about 68 mm and about 128 mm, more preferably a length of about 84 mm.

The smoking article may have a total nicotine free dry particulate matter or "tar" delivery of up to about 12 mg.

The smoking article preferably further comprises at least one circumferential row of perforations at a location along the filter in order to ventilate mainstream smoke drawn through the filter from the rod of smokable material. Preferably, the at least one circumferential row of perforations is located at least 12 mm from the mouth end of the filter.

In embodiments where the filter comprises at least two filter segments, the at least one circumferential row of perforations may be provided through the tipping paper at a location along the filter where two filter segments abut one another. With a circumferential row of perforations provided through the tipping paper at this location, the two filter segments are preferably at least partially separable from one another along the at least one circumferential row of perforations.

In a preferred embodiment, two or three circumferential rows of perforations are provided through the tipping paper at the location along the filter where two filter segments abut one another. In alternative embodiments, four or five circumferential rows of perforations may be provided through the tipping paper at the location along the filter where two filter segments abut one another.

Preferably, the circumferential rows of perforations are arranged symmetrically about the location along the filter where the two filter segments abut one another.

Preferably, one or more circumferential rows of perforations are provided through the tipping paper at each location along the filter where two filter segments abut one another, for example at two locations for a filter comprising three filter segments or at three locations for a filter comprising four filter segments.

Preferably, each circumferential row of perforations is formed by between about 20 perforations to about 50 perforations, more preferably by about 30 perforations.

According to an embodiment, a filter for a smoking article comprises at least one filter segment circumscribed by a plug wrap, wherein a tear ribbon is arranged between the at least one filter segment and the plug wrap and wherein the tear ribbon is affixed to the plug wrap.

BRIEF DESCRIPTION OF THE DRAWINGS

The invention will be further described, by way of example only, with reference to the accompanying drawings in which.

DETAILED DESCRIPTION

Figure 1:
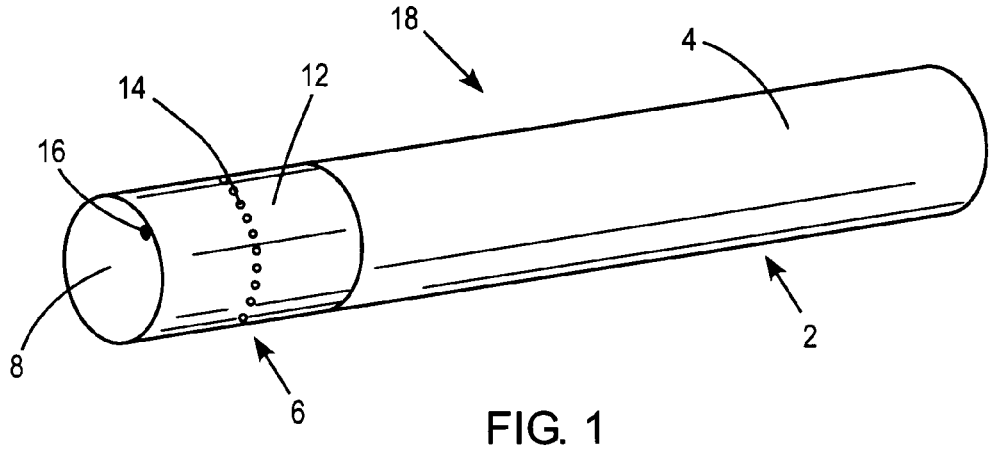
FIG. 1 shows a side view of a filter cigarette according to a first embodiment of the invention.

The filter cigarettes according to the first, second and third embodiments of the invention shown in FIGS. 1 to 5 have several components in common; these components have been given the same reference numerals throughout the following description.

Each filter cigarette comprises a rod 2 of tobacco cut filler wrapped in a rod wrapper 4, such as a cigarette paper, which is attached at one end to an axially aligned filter 6 comprising one or more filter segments 8 wrapped in a filter wrapper 10, such as a plug wrap. The wrapped tobacco rod 2 and the filter 6 are joined by tipping paper 12, which circumscribes the entire length of the filter 6 and an adjacent portion of the wrapped tobacco rod 2. To ventilate mainstream smoke produced during combustion of the wrapped tobacco rod 2 with ambient air, at least one circumferential row of perforations 14 is provided through the tipping paper 12 at a location along the filter 6.

Each filter cigarette also comprises a tear ribbon 16 between the one or more filter segments 8 and the tipping paper 12, substantially parallel to the longitudinal axis of the filter cigarette.

Figure 2:
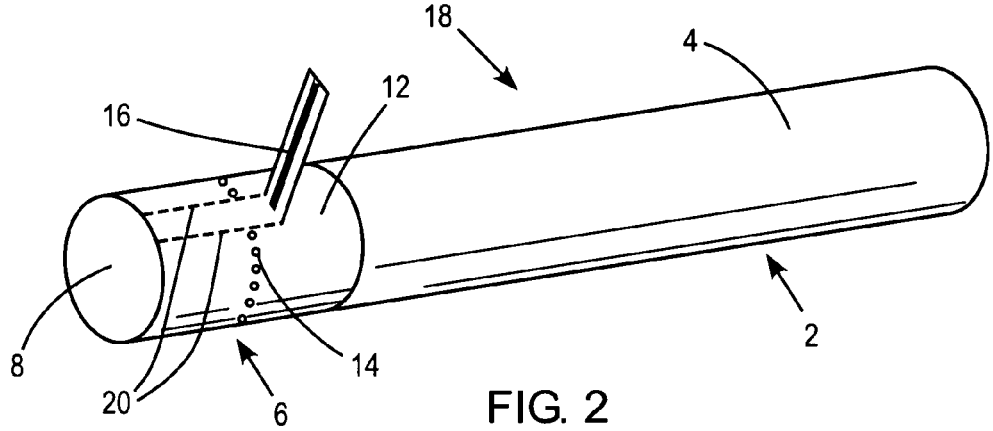
FIG. 2 shows a side view of the filter cigarette of FIG. 1 after pulling on the tear ribbon.

In the filter cigarette 18 according to the first embodiment of the invention shown in FIGS. 1 and 2 the tear ribbon 16 is parallel to the longitudinal axis of the filter cigarette 18 and extends longitudinally from the mouth end of the filter 6 along the entire length of the filter wrapper 10. The tear ribbon 16 of the filter cigarette 18 shown in FIG. 2 is adhered to the inner surface of the filter wrapper 10 between a pair of parallel, longitudinal, spaced apart, lines of perforations 20 provided in the filter wrapper 10.

In use, a consumer pulls on the end of the tear ribbon 16 visible at the mouth end of the filter 6 to tear open the tipping paper 12 and the filter wrapper 10 of the butt of the filter cigarette 18. As shown in FIG. 2, pulling on the end of the tear ribbon 16 tears open a strip of the filter wrapper 10 between the two lines of perforations 20 and an overlying strip of the tipping paper 12 of corresponding width. FIG. 2 shows the tipping paper 12 and the filter wrapper 10 torn open by pulling on the tear ribbon 16 with the remainder of the filter cigarette 18 intact. It will be appreciated, however, that in use a consumer pulls on the tear ribbon 16 in order to tear open the tipping paper 12 and the filter wrapper 10 of the butt of the filter cigarette 18 shown in FIG. 2 prior to disposal of the butt.

Figure 3:
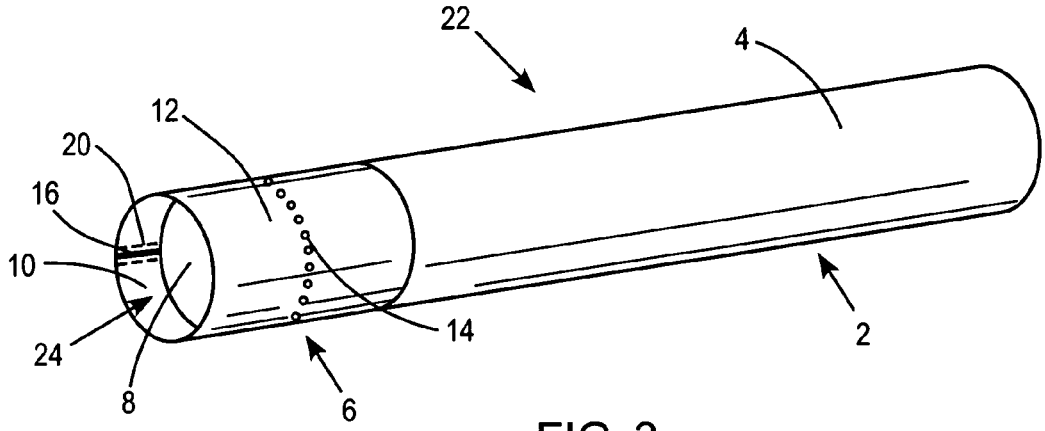
FIG. 3 shows a side view of a filter cigarette according to a second embodiment of the invention.

The filter cigarette 22 according to the second embodiment of the invention shown in FIG. 3 is of largely similar construction to the filter cigarette 18 according to the first embodiment of the invention shown in FIGS. 1 and 2. However, as shown in FIG. 3, in addition to at least one filter segment 8, the filter 6 of the filter cigarette 22 according to the second embodiment of the invention also comprises a recess 24 at the mouth end thereof. The tear ribbon 16, which is parallel to the longitudinal axis of the filter cigarette 22, extends longitudinally from the mouth end of the recess 24 of the filter 6 along the entire length of the filter wrapper 10.

As in the first embodiment of the invention, the tear ribbon 16 is adhered to the inner surface of the filter wrapper 10, which surrounds the at least one filter segment 8 and the recess 24, between a pair of parallel, longitudinal, spaced apart, lines of perforations 20 provided in the filter wrapper 10.

In use, a consumer pulls on the end of the tear ribbon 16 visible at the mouth end of the recess 24 of the filter 6 as previously described to tear open the tipping paper 12 and the filter wrapper 10 of the butt of the filter cigarette 22. The inclusion of the recess 24 at the mouth end of the filter 6 of the filter cigarette 22 according to the second embodiment of the invention advantageously facilitates grasping of the mouth end of the tear ribbon 16 by the consumer.

Figure 4:
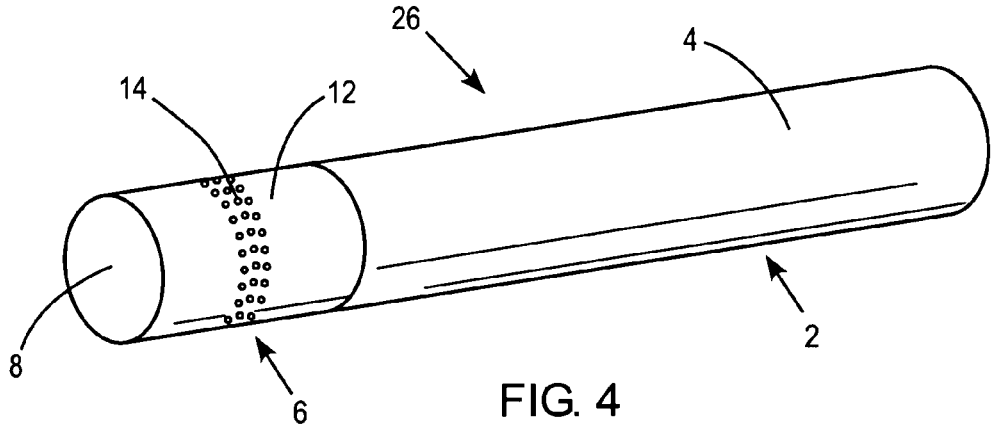
FIG. 4 shows a side view of a filter cigarette according to a third embodiment of the invention.
Figure 5:
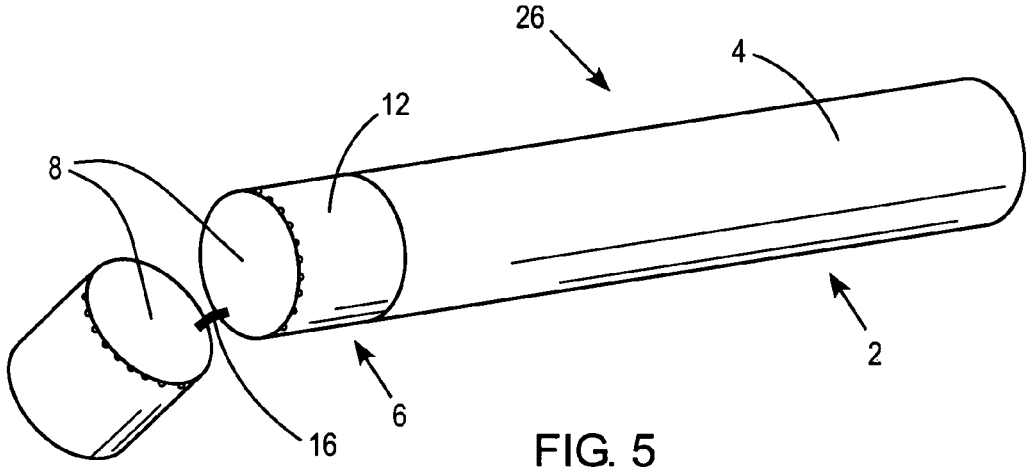
FIG. 5 shows a side view of the filter cigarette of FIG. 4 with the filter broken in two to reveal the tear ribbon.
Figure 6:
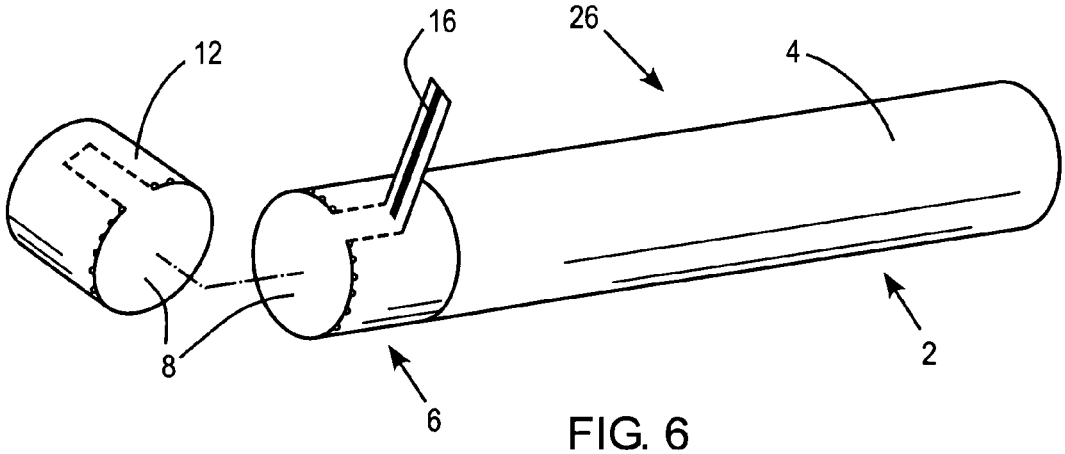
FIG. 6 shows a side view of the filter cigarette of FIG. 4 after pulling on the tear ribbon.

The filter 6 of the filter cigarette 26 according to the third embodiment of the invention shown in FIGS. 4, 5 and 6 comprises two filter segments 8. As shown in FIG. 4, three adjacent circumferential rows of perforations 14 are provided through the tipping paper 12 at the location along the filter 6 where the two filter segments 8 abut one another.

The filter wrapper 10 surrounds the two filter segments 8. The tear ribbon 16 is parallel to the longitudinal axis of the filter cigarette 26 and is adhered to the inner surface of the filter wrapper 10 between a pair of parallel, longitudinal, spaced apart, lines of perforations 20 provided in the filter wrapper 10.

In use, a consumer breaks open the filter 6 along the middle one of the three circumferential rows of perforations 14 (shown in bold in FIG. 4) in order to separate the two filter segments 8 of filtration material from one another. As shown in FIG. 5, breaking open the filter 6 exposes a central region of the tear ribbon 16, which is then pulled on by the consumer to tear open the tipping paper 12 and the filter wrapper 10 of the butt of the filter cigarette 26, as shown in FIG. 6. By dividing the filter 6 into smaller pieces, separating the two filter segments 8 by breaking open the filter 6 along the middle one of the three circumferential rows of perforations 14 advantageously further increases the rate of degradation of the butt of the filter cigarette 26.

The filters 6 of the filter cigarettes 18, 22 according to the first and second embodiments of the invention shown in FIGS. 1 and 3, respectively, may also comprise one or more filter segments 8. The filters 6 of the filter cigarettes 18, 22, 26 according to the first, second and third embodiments of the invention may comprise one or more filter segments 8 of material for filtration of the particulate phase of mainstream smoke drawn through the filter 6 from the rod 2 of tobacco cut filler. The material for filtration of the particulate phase may be, for example, cellulose acetate tow, crepe paper or any other suitable material known in the art. Alternatively, or in addition, the filters 6 may comprise one or more filter segments 8 of solid material for filtration of the gas phase filtration of mainstream smoke drawn through the filter 6 from the rod 2 of tobacco cut filler. The material for filtration of the gas phase may be, for example, activated carbon or any other suitable material known in the art. Where the filters 6 comprise one or more filter segments 8 of gas phase filtration material, the filter segments 8 of gas phase filtration material are preferably located proximate the ends of the filters 6 adjacent to the rods 2 of tobacco cut filler, distant from the mouth ends of the filter cigarettes 18, 22, 26. In addition, the filters 6 may comprise one or more filter segments 8 that are flavour-bearing. One or more of the filter segments 8 of the filters 6 may, for example, comprise flavour-bearing granules, one or more flavour-bearing threads, one or more flavour-containing breakable capsules or combinations thereof.

To produce filter cigarettes 18, 22, 26 according to the first, second and third embodiments of the invention, multi-segment filters 6 or single segment filters 6, as appropriate, are produced as described below and then joined to wrapped tobacco rods 2, which are produced in a conventional manner, by tipping paper 12 using known filter cigarette making equipment.

During production of the multi-segment or single segment filter 6, a line of adhesive is applied to the inner surface of the filter wrapper 10 between two lines of perforation lines 20 formed in the filter wrapper 10 by laser perforation. The tear ribbon 16 is then adhered to the inner surface of the filter wrapper 10 by being placed on the line of adhesive applied thereto. Alternatively, an adhesive may be applied to the tear ribbon prior 16 to placement of the tear ribbon 16 on the inner surface of the filter wrapper 10.

The filter wrapper 10 with the adhered tear ribbon 16 is used to manufacture a continuous filter rod comprising multiple units of the single segment or multi-segment filter 6 in a conventional manner. The continuous filter rod is severed at regular intervals by a cutting mechanism to yield a succession of discrete single segment or multi-segment filters 6 that comprise the tear ribbon 16.

Where filter cigarettes 18, 22, 26 according to the first, second and third embodiments of the invention comprise multi-segment filters 6, separate continuous rods comprising multiple units of each filter segment 8 of the filter 6 are initially produced in a known manner. The tear ribbon 16 is adhered to the inner surface of the filter wrapper 10 used to combine these separate rods to form a continuous filter rod comprising multiple units of the multiple-segment filter, as described above.

The invention has been exemplified above with reference to filter cigarettes comprising tear ribbons that are adhered to the inner surface of filter wrappers circumscribing the single segment or multi-segment filters thereof. It will be appreciated, however, that the tear ribbon of smoking articles according to the present invention may be affixed to the inner surface of the tipping paper or to the outer surface of the filter wrapper circumscribing the at least one filter segment of the filter or to both the inner surface of the tipping paper and the outer surface of the filter wrapper.

The invention claimed is:

1. A smoking article comprising:

a rod of smokable material circumscribed by a rod wrapper;

a filter comprising at least one filter segment circumscribed by a filter wrapper, wherein the rod of smokable material and the filter are attached to one another by tipping paper; and a tear ribbon between the filter segment and the tipping paper, wherein the tear ribbon is affixed to at least one of the tipping paper and the filter wrapper, wherein the tear ribbon is substantially parallel to the longitudinal axis of the smoking article, wherein the tear ribbon is operable to longitudinally rupture the tipping paper and the filter wrapper as the tear ribbon separates from the at least one of the tipping paper and the filter wrapper and wherein the tear ribbon extends the entire length of the filter wrapper, the filter wrapper comprising at least one line of perforation proximate the tear ribbon and the filter comprising at least one circumferential row of perforations to ventilate mainstream smoke.

2. A smoking article according to claim 1 wherein the tear ribbon is affixed to the filter wrapper.

3. A smoking article according to claim 1 wherein the tear ribbon is affixed to an inner surface of the filter wrapper.

4. A smoking article according to claim 1 wherein the filter further comprises a recess at the mouth end thereof distant from the rod of smokable material.

5. A smoking article comprising:

a rod of smokable material circumscribed by a rod wrapper;

a filter comprising at least one filter segment circumscribed by a filter wrapper, wherein the rod of smokable material and the filter are attached to one another by tipping paper;

a tear ribbon between the filter segment and the tipping paper, wherein the tear ribbon is affixed to at least one of the tipping paper and the filter wrapper, wherein the tear ribbon is substantially parallel to the longitudinal axis of the smoking article, wherein the tear ribbon is operable to longitudinally rupture the tipping paper and the filter wrapper as the tear ribbon separates from the at least one of the tipping paper and the filter wrapper; wherein at least one circumferential row of perforations is provided through the tipping paper at a location along the filter and wherein the tear ribbon extends the entire length of the filter wrapper, the filter wrapper comprising at least one line of perforation proximate the tear ribbon and the filter comprising at least one circumferential row of perforations to ventilate mainstream smoke.

6. A smoking article according to claim 5 wherein the filter comprises at least two filter segments and at least one circumferential row of perforations is provided through the tipping paper where two filter segments abut one another, the two filter segments being at least partially separable along the at least one circumferential row of perforations.

7. A filter for a smoking article comprising:

at least one filter segment circumscribed by a filter wrapper; and a tear ribbon between the filter segment and the filter wrapper, wherein the tear ribbon is affixed to the filter wrapper, wherein the tear ribbon is substantially parallel to the longitudinal axis of the smoking article, wherein the tear ribbon is operable to longitudinally rupture the tipping paper and the filter wrapper as the tear ribbon separates from the filter wrapper, wherein the tear ribbon is affixed to the filter wrapper and wherein the tear ribbon extends the entire length of the filter wrapper, the filter wrapper comprising at least one line of perforation proximate the tear ribbon and the filter comprising at least one circumferential row of perforations to ventilate mainstream smoke.

8. The filter of claim 7 wherein the tear ribbon is affixed to an inner surface of the filter wrapper.

9. The filter of claim 7 wherein the filter further comprises a recess at the mouth end thereof distant from the rod of smokable material.

10. The filter of claim 7 wherein at least one circumferential row of perforations is provided through the tipping paper at a location along the filter.

11. The filter of claim 10 wherein the filter comprises at least two filter segments and at least one circumferential row of perforations is provided through the tipping paper where two filter segments abut one another, the two filter segments being at least partially separable along the at least one circumferential row of perforations.

* * * * *